US005454317A

United States Patent [19]

Kobler et al.

[11] Patent Number: 5,454,317

[45] Date of Patent: Oct. 3, 1995

[54] APPARATUS FOR THE AUTOMATIC CHANGING OF PRINTING PLATES

[75] Inventors: Ingo Kobler, Anhausen; Georg Hartung, Seligenstadt; Christian Brautigam, Obertshauseu; Helmut Schild, Steinbach/Taunus, all of Germany

[73] Assignee: MAN Roland Druckmaschinen AG, Germany

[21] Appl. No.: 217,947

[22] Filed: Mar. 25, 1994

[30] Foreign Application Priority Data

Mar. 25, 1993 [DE] Germany ..... 43 09 658.1

[51] Int. Cl.[6] ..... B41F 21/00

[52] U.S. Cl. ..... 101/477; 101/216; 101/415.1

[58] Field of Search ..... 101/216, 378, 101/382.1, 415.1, 477, DIG. 36

[56] References Cited

U.S. PATENT DOCUMENTS

| | | | |
|---|---|---|---|
| 4,727,807 | 3/1988 | Suzuki et al. | 101/415.1 |
| 5,074,212 | 12/1991 | Kobler et al. | 101/477 |
| 5,111,744 | 5/1992 | Wieland | 101/216 |
| 5,127,322 | 7/1992 | Kobler | 101/219 |
| 5,127,328 | 7/1992 | Wieland | 101/415.1 |
| 5,331,892 | 7/1994 | Seib et al. | 101/477 |

FOREIGN PATENT DOCUMENTS

| | | |
|---|---|---|
| 0100778B1 | 6/1986 | European Pat. Off. . |
| 0329872A1 | 8/1989 | European Pat. Off. . |
| 0432660A2 | 6/1991 | European Pat. Off. . |
| 0435410A2 | 7/1991 | European Pat. Off. . |
| 4003445C2 | 12/1991 | Germany . |
| 4140413A1 | 6/1993 | Germany . |
| 3940796C2 | 10/1993 | Germany . |
| 62-221542A | 9/1987 | Japan . |

OTHER PUBLICATIONS

*Druckwelt* 4/25 Februar 1993 "Automatisierter Plattenwechsel".

*Primary Examiner*—Chris A. Bennett
*Attorney, Agent, or Firm*—Leydig, Voit & Mayer, Ltd.

[57] ABSTRACT

An apparatus for the automatic changing of new and used printing plates in sheet-fed offset printing machines, having a plurality of printing units, includes a central printing plate storage container and a printing plate transport apparatus. Mounted on each plate cylinder of a printing unit is a guide device which is pivotable so as to be capable of being thrown onto the plate cylinder and off from the latter and via which a new printing plate can be fed from above to the plate cylinder and, with the plate cylinder slowly rotating backwards, a used printing plate can also be conveyed out and upwards. Mounted above the printing machine is a guide rail on which a travelling carriage of the transport apparatus, having plate gripping and lifting devices, can be moved along all the printing units of the printing machine. The transport apparatus conveys the used printing plates from the printing units to the central printing plate storage container and, from the latter, new printing plates are provided to the respective printing units, where these printing plates are fed to the plate cylinder via the gripping and lifting device and via the respective thrown-on guide device.

6 Claims, 4 Drawing Sheets

APPARATUS FOR THE AUTOMATIC CHANGING OF PRINTING PLATES

FIELD OF THE INVENTION

The present invention relates generally to an apparatus for the automatic changing of printing plates in sheet-fed offset printing machines and more particularly concerns such automatic plate changing apparatus for printing machines having a plurality of printing units.

BACKGROUND OF THE INVENTION

To change the printing plates in sheet-fed offset printing machines, the used printing plate is usually removed first. This begins by opening a tension or clamping rail which normally grips the trailing or print end of the printing plate. With the plate cylinder slowly rotating backwards, this used printing plate is then conveyed out of the printing unit. After the tension or clamping rail gripping the leading or print start end of the plate has been opened, the printing plate can be extracted completely from the printing unit. The drawing on of a new printing plate thereupon takes place. Here the leading or print start end of this printing plate is inserted into the corresponding print-start tension rail. The plate cylinder is thereupon moved slowly in the forward direction of rotation and the printing plate is thus drawn around the cylinder and the print end of the printing plate is then inserted into the corresponding tension rail.

The work sequence briefly outlined above for changing a printing plate in a printing unit necessitates a correspondingly large number of manual handling operations on the devices of the plate cylinder, the printing unit and with the printing plate itself. For this reason, the changing of printing plates in a multicolor sheet-fed offset printing machine having a plurality of printing units takes up a correspondingly large amount of time.

So that some of the manual handling operations during the changing of printing plates can be avoided, there have already become known so-called semi-automatic printing plate changing systems, in which, in particular, the clamping, release, tensioning and loosening of the printing plates in the corresponding devices of the plate cylinders (tension rails) are executed automatically. Only the introduction and removal of the printing plates then still have to be carried out by an attendant. By means of additional introduction aids or other means of assistance, the necessary handling operations during the introduction of a new printing plate can be reduced and, thus, a saving of time in execution. An introduction aid of this kind is described under the designation "PPL" in the German periodical "Druckwelt" ("Printing World"), 4, 25th Feb. 1993, pages 28–29.

The apparatuses disclosed by EP 0,435,410 A2 and EP 0,432,660 A2 for the fully automatic change of printing plates in sheet-fed offset printing machines make any tending actions during the cycle of the printing plate changing operation unnecessary. Thus, there is provided on each printing unit a complete printing plate changing apparatus which consists essentially of a storage chamber for the supply and reception of one or more new or used printing plates respectively, and of a transport or conveying mechanism, by means of which the printing plates can be conveyed from the plate cylinder into the storage chamber and from the storage chamber onto the plate cylinder. According to EP 0,435,410 A2, the storage chamber can receive a plurality of printing plates for a number of consecutive runs, so that the printing machine can be prepared for a specific number of printing orders. According to this publication, the printing plate changing apparatus pivotably is arranged on a subsequent tower of a printing unit so as to be capable of being thrown onto the plate cylinder and thrown off from the latter.

According to the prior publications mentioned above, the apparatus located on each printing unit for the automatic printing plate change are fed with new printing plates by an attendant, for example during the printing run, or the used printing plates located in the storage chamber have to be extracted by an attendant. A correspondingly large number of handling operations have to be carried out in the individual storage chambers of the printing plate changing apparatuses assigned to the printing units. In the case of the storage chamber provided in EP 0,435,410 A2 for a specific number of new printing plates, a reorganization regarding the plate order or sequence for the printing machine sometimes results in an extremely arduous resorting or exchange with the printing plates already inserted into the storage chamber.

In the printing plate changing apparatuses disclosed by the publications mentioned, a general disadvantage is that a complete apparatus, consisting of a storage chamber and a transport/conveying mechanism for the printing plates, must be provided on each printing unit. Precisely where a large number of printing units is concerned, this results in a correspondingly high expense in terms of construction costs. A further disadvantage arises from the additional constructional space in the region between the printing units, which these previously known apparatuses require. Also, in the previously known printing plate changing systems, although there is provision for arranging these so as to be capable of being thrown onto and thrown off from the plate cylinder or for mounting them so as to be capable of being otherwise pivoted away, nonetheless, in the very confined space between the printing units of a sheet-fed offset printing machine of medium size, there is often considerable restriction in the freedom of movement of an attendant who has to carry out, for example, a rubber-blanket change, a change of an ink applicator roller or other service work. In addition to the disadvantages already mentioned, the previously known apparatuses allow only a fully automatic change of the printing plates and, in the event of a failure of or damage to a printing plate changer on one or more printing units, the printing plates have to be changed in the customary way by hand, if this is still at all possible.

EP 0,100,778 B1 discloses an apparatus for the automatic exchange of printing plates, which has a conveying unit for conveying the plate to a predetermined point on a printing station and a delivery unit for removing the plate from the conveying unit and for feeding this printing plate to the plate cylinder. This previously known apparatus provides special printing plates having, in particular, special holding mechanisms, such that the plate holding means form elastic units with the printing plates mountable on them. However, in conventional sheet-fed offset printing machines of the type under consideration here and in widespread use, special plate-holding means of this type, together with compatible printing plates, cannot be used.

OBJECTS AND SUMMARY OF THE INVENTION

The primary aim of the present invention is to provide a fully automatic printing plate changing system for a plurality of printing units which, moreover, can be used in a more versatile way and can also be extended to accommodate additional printing units. In general, this object is achieved by providing a printing plate storage container having a plurality of compartments for storing new and used printing plates and a transport apparatus movable between the storage container and all of the plurality of printing units for delivering and retrieving printing plates.

According to the invention, provision is made for arranging on each printing unit, in the region of the plate cylinder, a guide device which is pivotably mounted so as to be capable of being thrown onto the plate cylinder and thrown off from the latter and by means of which a printing plate located on the plate cylinder can, after release of the tension device assigned to the trailing or print end, be conveyed out of the printing unit in a controlled manner, with the plate cylinder slowly rotating backwards, so that this conveyed out end of the printing plate can be grasped by a transport apparatus, described in more detail further below, or by holding devices located on this and, after the release of the clamping device assigned to the leading or print start end of the plate, can be conveyed away from the printing unit.

According to the invention, the guide device provided on each printing unit is such that a new printing plate, supplied on this very printing unit by the transport apparatus, together with the controllable holding devices, can, after a corresponding positioning of the plate cylinder, be conveyed into the opened clamping device assigned to the leading or print start end of the plate. Thereafter, the controllable holding devices of the transport apparatus, which likewise retain the new printing plate on its trailing or print end region, release the printing plate, and the new printing plate is drawn onto the plate cylinder as a result of the slow rotation of the latter in the forward printing direction. By means of a pressure roller which can be thrown onto the plate cylinder, the trailing or print end of the printing plate is introduced into the opened rear tension device and is thereupon tensioned automatically. The operation broadly described above is repeated on each printing unit, until all the plate cylinders are each supplied with a new printing plate.

Furthermore, according to the invention, provision is made for providing, in addition to the guide devices provided on the individual plate cylinders of the printing units, a transport apparatus which is assigned to all the printing units and, in particular, is movable along these and has controllable holding devices, by means of which a used printing plate conveyed out a little way on the printing unit via the guide devices can be grasped in the region of its print end and thereupon be removed completely from the plate cylinder. At the same time, by means of a second controllable holding device of a movable transport apparatus, a new printing plate is fed to the plate cylinder via the guide device.

After the movable transport apparatus has extracted a used printing plate from a printing unit and delivered a new printing plate, a central supply location in the form of a printing plate container is approached by the transport apparatus and there the used printing plate is deposited and a new printing plate preselected for the next printing unit is received by the second controllable holding device. Subsequently, the next printing unit is approached by the transport apparatus and the operation described is repeated.

According to a preferred exemplary embodiment of the invention, the movable transport apparatus is suspended via rollers on a guide rail mounted above the printing machine, so that the transport apparatus, together with the controllable holding devices, can be moved over all the printing units and to the location of the common printing plate storage container. The guide rail can be fastened either to the ceiling of the printing room or to each printing unit between its feeder and delivery portions by means of additional supports.

In further accordance with a preferred exemplary embodiment of the invention, the transport apparatus has two controllable holding devices, one holding device being provided for receiving a used printing plate conveyed out of the printing unit, and the second holding device supplying the new printing plate to be fed in. The holding devices are designed as grippers and/or pneumatic suckers and grasp the respective printing plate at a plurality of points in the region of its trailing or print end. The holding devices are mounted on the transport apparatus via lifting devices, so that, when the transport apparatus is mounted on a guide rail above the printing machine, the printing plate can be lowered from a raised position and, at the same time, fed to the plate cylinder via the guide device. The holding device for the used printing plate to be discharged is also designed so as to be capable of being raised and lowered via a lifting device, so that, after the lowering of the holding device, the printing plate conveyed out virtually completely can be gripped or sucked up and then raised. The lifting distance to be covered depends essentially on the printing plate format, since, according to the preferred exemplary embodiment of the invention, the new printing plates to be fed and the old printing plates to be discharged are conveyed above and beyond the printing units.

A particular advantage of the invention is that there is provided on each printing unit only one guide device which is simple to produce in terms of construction and by means of which the printing plates can be fed to the plate cylinder and be conveyed away from the latter. Each printing unit thus has a semiautomatic printing plate changing apparatus. As a result of the low outlay in terms of new equipment in the region of the printing unit, little additional constructional space is also required.

The fact that only one movable transport apparatus with controllable holding devices is provided for all the printing units constitutes a decisive advantage of the invention. Since the printing plates are moved from a central storage location to the respective printing units by means of the transport apparatus provided according to the invention, the concept according to the invention constitutes a basis for automatic printing plate logistics within a printing plant which are capable of being extended in many ways.

If print orders are changed over for a short time or the sequence of the printing plates to be clamped on is changed, this no longer has to be carried out on the individual printing units, as in the conventional printing plate changing systems, but can be conducted at the central storage location, without long distances being involved. The supply location for the printing plates, which is designated here as a common storage location and from which the movable transport apparatus according to the invention extracts the new printing plates, can be a printing plate container which constitutes an interface between, for example, a driverless transport system for the printing plates within the preliminary printing stage and the very printing plate changing system according to the invention which is described here.

If, for example, two printing machines are arranged in series, then it is also possible, according to the invention, with a single movable transport apparatus to change the printing plates even on two printing machines which accordingly possess on all the printing units the guide devices provided according to the invention. The advantage, already of decisive importance in the case of one printing machine, that only one transport apparatus is required then brings about a substantially greater reduction in the overall expenses.

The central storage location for the new printing plates to be supplied and for the used printing plates to be received can advantageously be a self-propellable printing plate container which transports printing plates either by the attendance of a person or in a driverless manner.

An essential advantage of the invention is that, even without a movable transport apparatus, the printing machine still has the possibility of a convenient printing plate changing system. Since, on each printing unit, the plate cylinders have remotely actuable automatic devices for clamping and tension and, furthermore, the guide device provided according to the invention, the printing plates can also be changed manually and relatively quickly, particularly in the event of possible defect of the movable transport apparatus. Moreover, this concept affords a design solution, according to which it is possible first to procure a printing machine which has the provided guide devices on each printing unit, and, after some time, especially when the corresponding need is established, to install the movable transport apparatus additionally as a retrofitting upgrade.

As a further development of the invention, provision can be made for applying to each printing plate, in the region of the print end, a sensor-scannable coding (for example, EAN code), from which the order, printing ink, inking sequence, ink-feed presetting, etc. can be taken in encoded form and which can be scanned by an appropriate sensor assembly on the controllable holding device. By means of this coding on each printing plate and the sensor assembly on the holding device, it becomes simpler to find the required printing plate at the central storage location or in the printing plate container and, furthermore, it is possible to cause corresponding presetting data, especially for the inking control of the individual printing units, to be set automatically.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 5 shows a schematic elevation of the printing machine according to FIG. 1, as seen from the delivery end.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
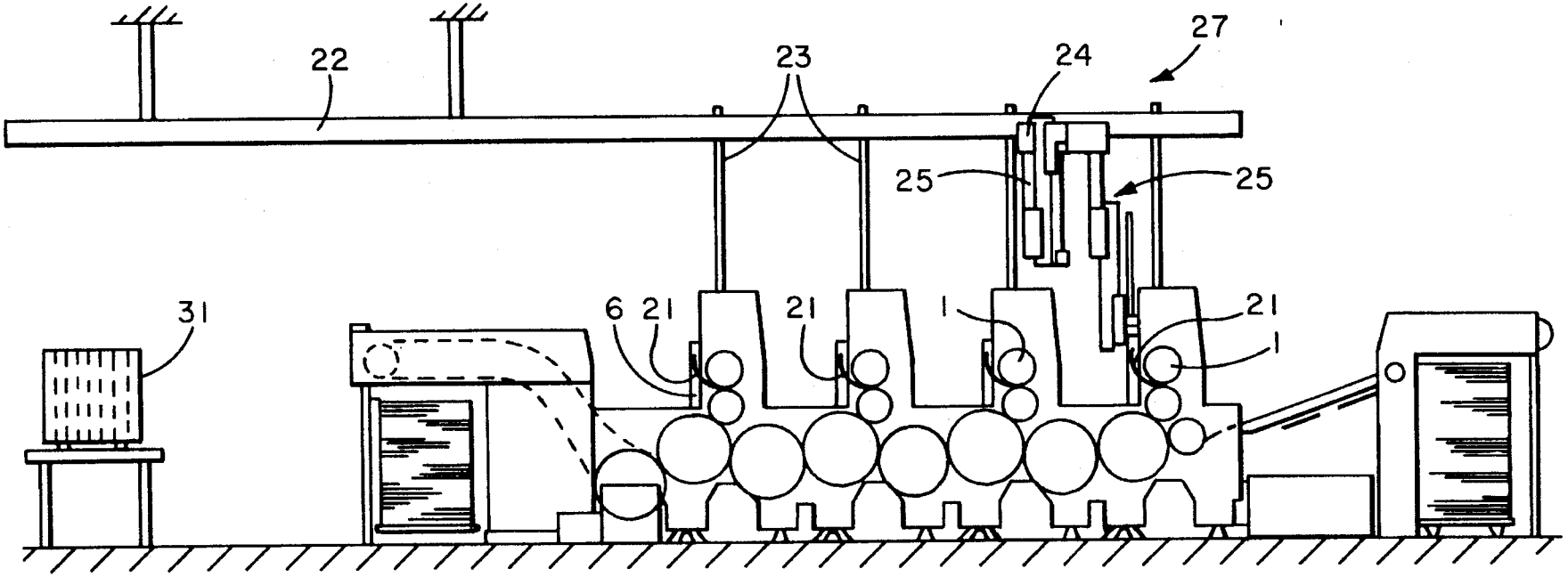
FIG. 1 shows, in schematic form, an overall side view of a printing machine having the automatic printing plate changing apparatus according to the present invention.

Turning now to the drawings, FIG. 1 illustrates a printing machine having the apparatus according to the invention, consisting of a guide device 21 mounted on its respective printing unit and of a movable transport apparatus 27 located above it. For convenience, the design and functioning of the guide device 21 will be described first with reference to FIG. 2.

Figure 2:
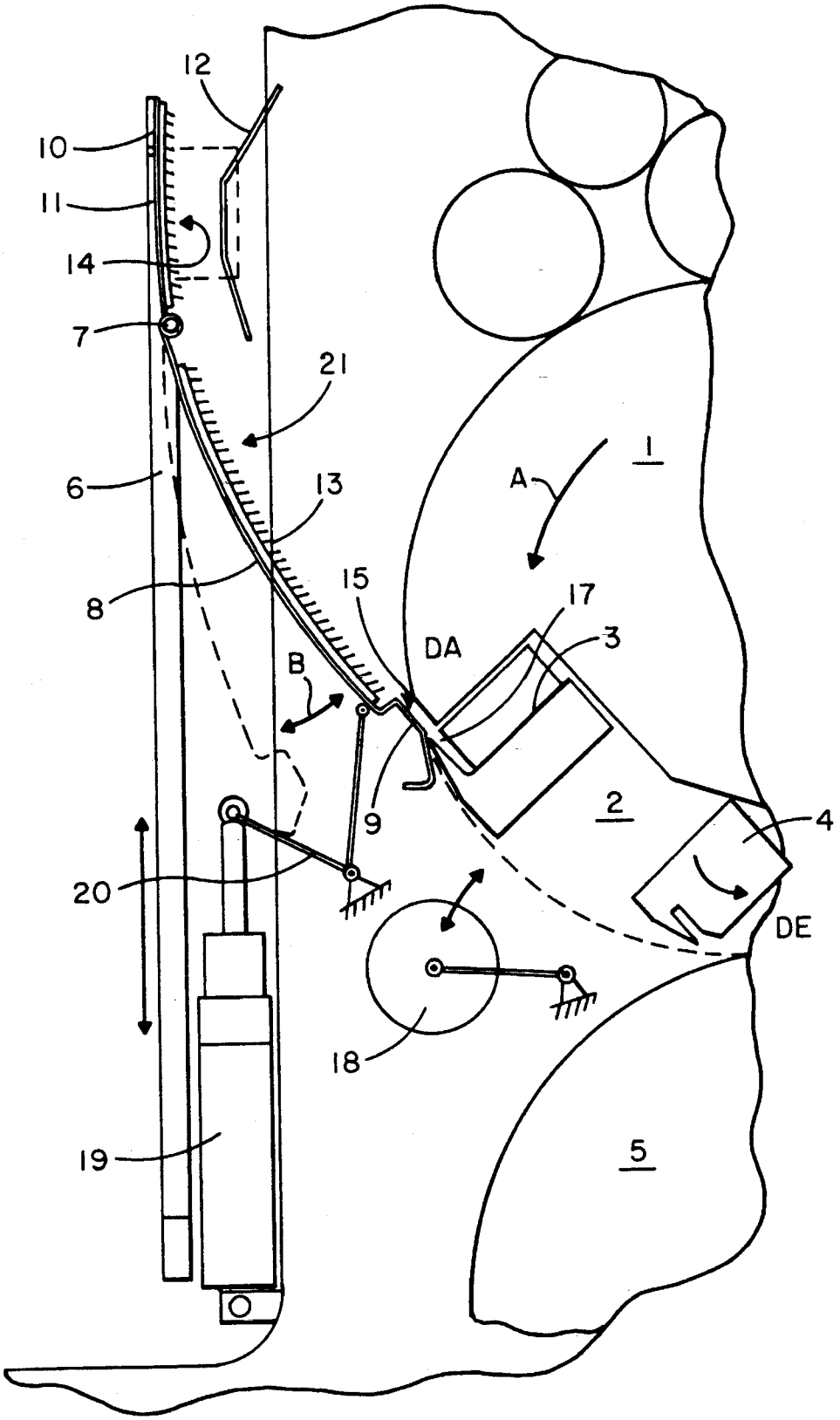
FIG. 2 is an enlarged, fragmentary schematic view showing a guide device on each printing unit.

FIG. 2 shows, as a cutout, part of a sheet-fed, offset printing unit of a printing machine of the in-line type. Mounted between the two side frames of this printing unit is a plate cylinder 1 which includes a recessed cylinder gap 2, in which are disposed a pair of clamping or tension rails 3 and 4 assigned to the print start DA and to the print end DE of the cylinders 1. The clamping rails 3, 4 are remotely actuable for clamping/tensioning the leading and trailing ends of the printing plate. Located above the plate cylinder 1 are the rollers of a conventional inking unit, of which two applicator rollers are generally and schematically indicated in FIG. 2.

A guard 6 is arranged displaceably, via a respective guide rail mounted on a side frame of the printing unit and in front of the printing unit having the plate cylinder 1 and the rubber blanket cylinder 5 located underneath it. For access to the printing unit cylinders, particularly in order to change the rubber blanket, the guard 6 can be displaced, as generally indicated by the arrow C. The guard 6 extends over the entire width of the printing unit.

Preferably mounted as a rotary joint on the upper part of the guard 6 is a pivot axle 7, on which a profiled sheet metal member 8 is suspended. The sheet metal member 8 has a concave curvature and is of the same format width as the plate cylinder 1. Mounted on the pivotable or free end of the profile, sheet metal member 8 is an introduction rail 9 which, as a result of the pivoting of the sheet metal member 8, can be pivoted onto the outer circumference of the plate cylinder 1 or off from this as shown generally by the arrow B. In the embodiment illustrated in FIG. 2, the introduction rail 9 is defined by means of an appropriate profiling of the pivotable end of the sheet-metal profile 8.

Mounted on an upper crosspiece 10 of the guard 6 is a guide plate 11 which is drawn down almost as far as the top edge of the profile sheet-metal member 8, that is to say approximately level with the pivot axle 7. A guide plate 12 having two bent legs is likewise mounted on the guard 6 opposite the guide plate 11. The guide plates 11 and 12 extend over the width of the guard 6 and over the format width of the plate cylinder 1 respectively, and form a gap for leading through a printing plate. Preferably, the guide means is also provided with a side fence which is mounted displaceably according to the format of the printing plate and which ensures that a new printing plate to be fed in is introduced in the correct side-register direction.

Arranged on the concavely shaped inner face of the curved sheet-metal number 8 are brushes 13 which are spaced from one another in a plurality of strips. Via the bristles of the brushes, a printing plate can be supported carefully on its printing side. Brushes 14 are likewise arranged on the guide plate 11 of the crosspiece 10 for the careful support of the printing plate. Alternatively and instead of the preferred brushes 13, 14, other devices can also be provided for the scratch-free or wear-free support of the printing plate.

The introduction rail 9 at the pivotable end of the sheet metal member 8 has the profile shown in FIG. 2 and possesses an introduction face 15 which points towards the plate cylinder 1 and which is substantially level with the bristles of the brushes 13.

To introduce a new printing plate, the profiled sheet metal member 8 is pivoted onto the plate cylinder 1, as shown in FIG. 2, for which purpose the latter is previously rotated into the corresponding position shown. The introduction rail 9 has a respective stop in its extension (not shown) located on both sides, by means of which stop it is supported on special supporting faces of the tension rail. The corresponding faces on the tension rail are designed so that, in the event of a deviation from the desired position of the cylinder, the introduction face 15 varies its relative position in relation to the tension rail 3 only insignificantly. At the same time, for the spacing of the introduction rail 9 relative to the print start DA of the plate cylinder 1, the stops are designed in such a way that the introduction face 15 is located level with the opened grasping region 17 of the clamping or tension rail 3.

A new printing plate to be fed can then be introduced, either by hand or, as will be described, via the controllable holding device, at the top of the guard 6 between and down through the guide plate 11 and the opposite guide plate and, with it being supported on the sheet metal member 8 via the brushes 13, directly into the opened tension rail 3. As can be seen in FIG. 2, the introduction face 15 of the introduction rail 9, on the one hand, and the outer circumference of the plate cylinder 1 in the region of the print start DA, on the other hand, constitute a funnel which extends over the format width of the plate cylinder i and which ensures that the leading front edge of the printing plate can be introduced directly into the gap-shaped grasping region 17 of the tension rail 3.

After a printing plate leading edge has been introduced into the front tension rail 3, the clamping of the printing plate takes place as a result of the closing of the grasping region 17. The guide device 8, 9, consisting of the profiled sheet metal member 8 with the introduction rail 9 can then be pivoted off the plate cylinder 1 again. The plate cylinder 1 is then set in slow forward rotation by an appropriate activation of the main drive of the printing machine, the printing plate being simultaneously drawn on and around the outer circumference of the plate cylinder 1. In FIG. 2, there is provided a pressure roller 18 which is mounted so as to be capable of being thrown on and off relative to the plate cylinder 1 and by means of which the printing plate is pressed onto the outer circumference of the plate cylinder 1 during the drawing on operation. The pressure roller 18 extends over the entire format width and can be thrown on and off, for example, via two bearing levers (one on each side frame of the printing machine) and via a respective pneumatic cylinder. As is known from the state of the art, a pressure roller 18 of this type can introduce the trailing end of the printing plate into a correspondingly designed tension rail 4 of the printing end DE. The tension rail 4 is then clamped closed via remotely actuable devices in the plate cylinder.

For pivoting the guide device 8, 9 on and off, there is mounted, for example, on each of the two side frames of the printing machine, a pneumatic cylinder 19 which causes the corresponding pivoting of the sheet metal member 8 of the guide device 21 via a respective angle lever 20 mounted fixedly relative to the frame and via a respective driving pin (not shown) attached thereto. 0f course, the pneumatic cylinders 19 can also be mounted directly in the guard 6 and be articulated directly on the sheet metal member 8.

To remove a printing plate located on the plate cylinder 1, the corresponding procedure takes place in the opposite direction to the sequence described above. For this purpose, the guide device 8, 9 can remain in the position of rest, that is to say in the state not pivoted on to the plate cylinder 1 (this rest position is represented by broken lines in FIG. 2). After an appropriate positioning of the plate cylinder 1, the tension rail 4 of the print end DA is opened, so that the trailing or print-end region of the printing plate jumps out of the tension rail 4 and, as a result of the slow backward rotation of the plate cylinder 1, is conveyed, being supported on the guide device 8, 9, into the gap between the guide plates 11 and 12. The printing plate can then be extracted there by hand or, as will be described in more detail, grasped by a controllable holding device and, after the opening of the print-start tension rail 3, can be removed from the region of the plate cylinder 1.

It will be understood that a guide device 21, described in detail above, is constructed identically on each printing unit of the sheet-fed offset printing machine. In a sheet-fed offset printing machine of the in-line type according to FIG. 1, the guide devices 21 in the guards 6 of the printing units are merely indicated schematically. The introduction gap between the guide plates 11, 12 (FIG. 2) is not visible in the illustration according to FIG. 1.

Arranged above the printing machine shown in FIG. 1 is a guide rail 22 which is fastened, for example via bridge-shaped supports 23, to each printing unit and by further suspensions on the ceiling of the printing room. The guide rail 22 can also be mounted exclusively on the ceiling of the printing room. The supports have, for example, the form as shown in FIG. 5. The profile of the guide rail 22 is, in particular, of generally an inverted T-shaped configuration on the underside (FIG. 5).

A travelling carriage 24 is suspended movably in the manner of a travelling trolley along the guide rail 22. The travelling carriage 24 preferably has its own drive, by means of which it can be moved along the guide rail 22 and be stopped exactly in specific pre-selected positions.

Arranged on the underside of the travelling carriage 24 are two lifting devices 25 which each have on their underside a controllable holding device 26 for gripping or grasping the print end of a printing plate. The holding devices 26 can, for example, be vacuum actuated suckers and/or mechanical grippers or a combination of devices of this type.

It can be seen in the illustration according to FIG. 1 that the guide rail 22 extends at such a height above the printing units of the printing machine that the two lifting devices 25, with a printing plate located on them, can be moved in the raised state above the printing units. In particular, the height of the guide rail 22 is selected so that the travelling carriage 24 together with the lifting devices 25 can be moved over and beyond the feeder and delivery sections of the printing units and a printing plate fastened to the holding device 26 can be transported safely above a person standing adjacent to one of the printing units.

Referring again to FIGS. 3 and 4, there is shown, in detail, the transport apparatus designated as a whole by 27 located above a printing unit. The two lifting devices 25, with the holding devices 26 located on them for holding the printing plates, are constructed identically according to this exemplary embodiment and consist of a first lifting drive 28 which is mounted underneath the travelling carriage 24 via a fastening arm, and of a second lifting drive 29, on which the holding device 26 for grasping a printing plate is mounted.

The first lifting drive 28 cooperates respectively with a rail 30, in such a way that this rail 30 can be lowered downwards or be pulled up completely. The two end positions of the rail 30 in relation to the first lifting drive 28 can be seen by referring to FIGS. 3 and 4.

The rail 30 has, in its preferred embodiment, a generally H-shaped profile and can cooperate with the first lifting drive 28, for example by means of corresponding rollers and by friction or, alternatively can be positively engaged in the manner of a rack drive. At the same time, the length of the rail 30 is selected somewhat greater than the maximum format length of the printing plates to be used.

The second lifting drive 29 is respectively arranged movably along the rail 30 and, in particular, cooperates with the rail 30 on the same principle as the lifting drive 28. It can be seen in FIGS. 3 and 4 that the second lifting drive 29 is located at the upper end of the rail 30 when the rail 30 has been pulled upwards into its end position by the first lifting drive 28, that is to say the rail 30 is grasped in the region of its lower end by the first lifting drive 28. The second position to be assumed corresponds to that in which the first lifting drive 28 has moved the rail 30 completely downwards and the second lifting drive 29 has been moved along the rail 30 into the lower end position. The lifting drives 28, 29 are connected to one another in control terms, so that the above-described positions, namely the basic position and the position extended completely downwards, are approached simultaneously. The two lifting devices 25 mounted on the travelling carriage 24 thus constitutes a telescopic lifting system.

Figure 3:
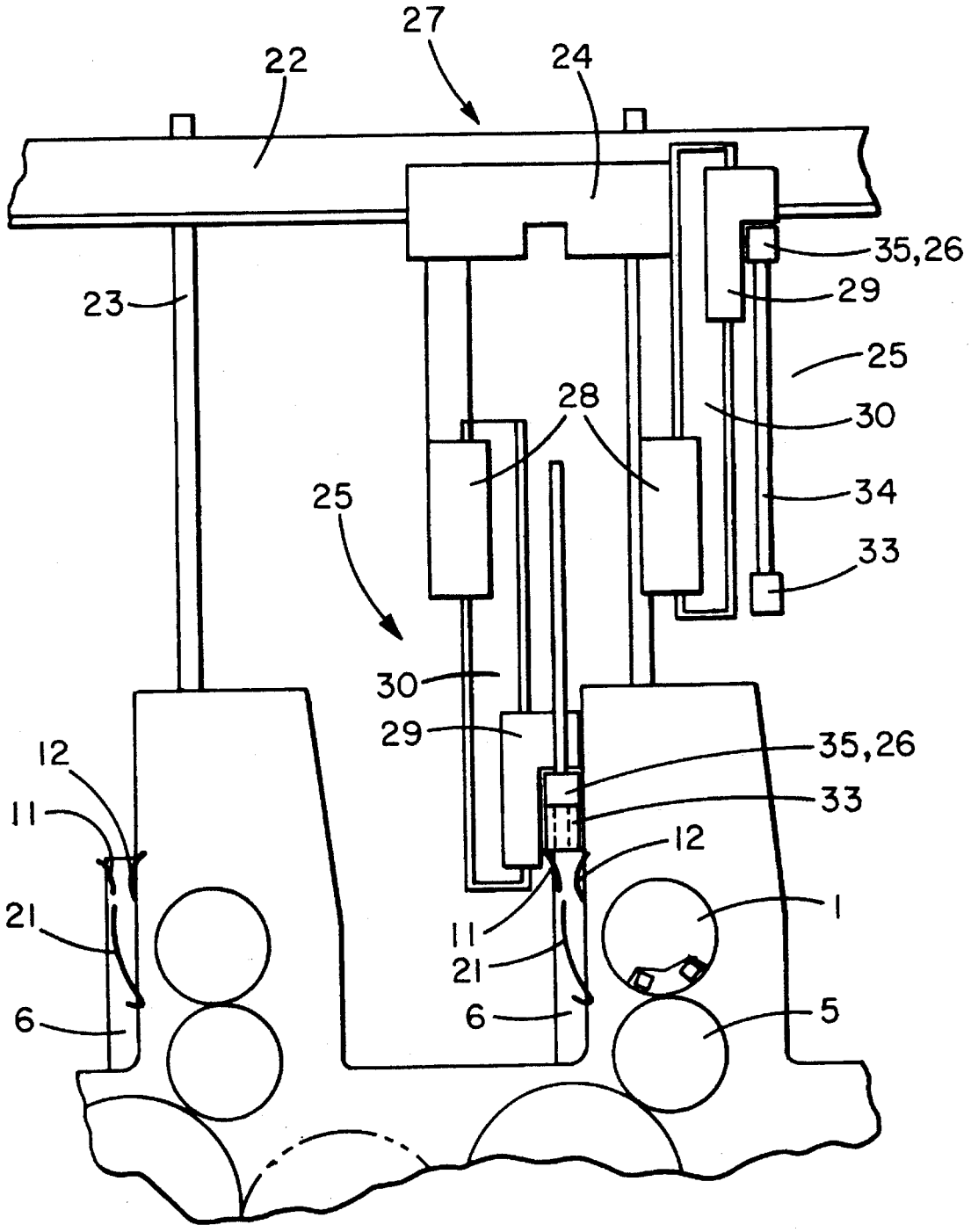
FIGS. 3 and 4 show schematic side views of a printing unit having the transport apparatus according to the invention, in two working positions.

FIG. 3 shows the transport apparatus 27 according to the invention which is located above a printing unit and in which, as a result of an appropriate activation of the first and second lifting drives 28, 29, the lifting device 25 shown on the left has been moved into the lower end position. There, after the appropriate positioning of the travelling carriage 24, the holding device 26 may grasp an used printing plate conveyed out of the gap between the guide plates 11, 12. The holding device 26 on this lifting device 25 is therefore positioned in such a way that the trailing or print end of a printing plate is, for example, conveyed directly into the opened grippers of the holding device 26. There can also be provided on the holding device 26 sensors which detect the presence of a printing plate and which then activate the grippers for grasping the printing plate.

After the grippers have grasped a used printing plate in the position of the lifting device 25 according to FIG. 3 and, after a corresponding backward rotation of the plate cylinder 1 (FIG. 2) and the corresponding opening of the print-start clamping and tension rail 3, this used printing plate has been released from the plate cylinder 1, the left-hand lifting device 25 can be moved back into its initial position again, so that the used printing plate located on the holding device 26 is pulled upwards. The left-hand lifting device 25 is therefore moved into the position according to FIG. 4.

A new printing plate, which is to be drawn onto the plate cylinder 1 of the printing unit, is already located on the lifting device 25 shown on the right in FIG. 3, that is to say on the holding device 26 present there.

Figure 4:
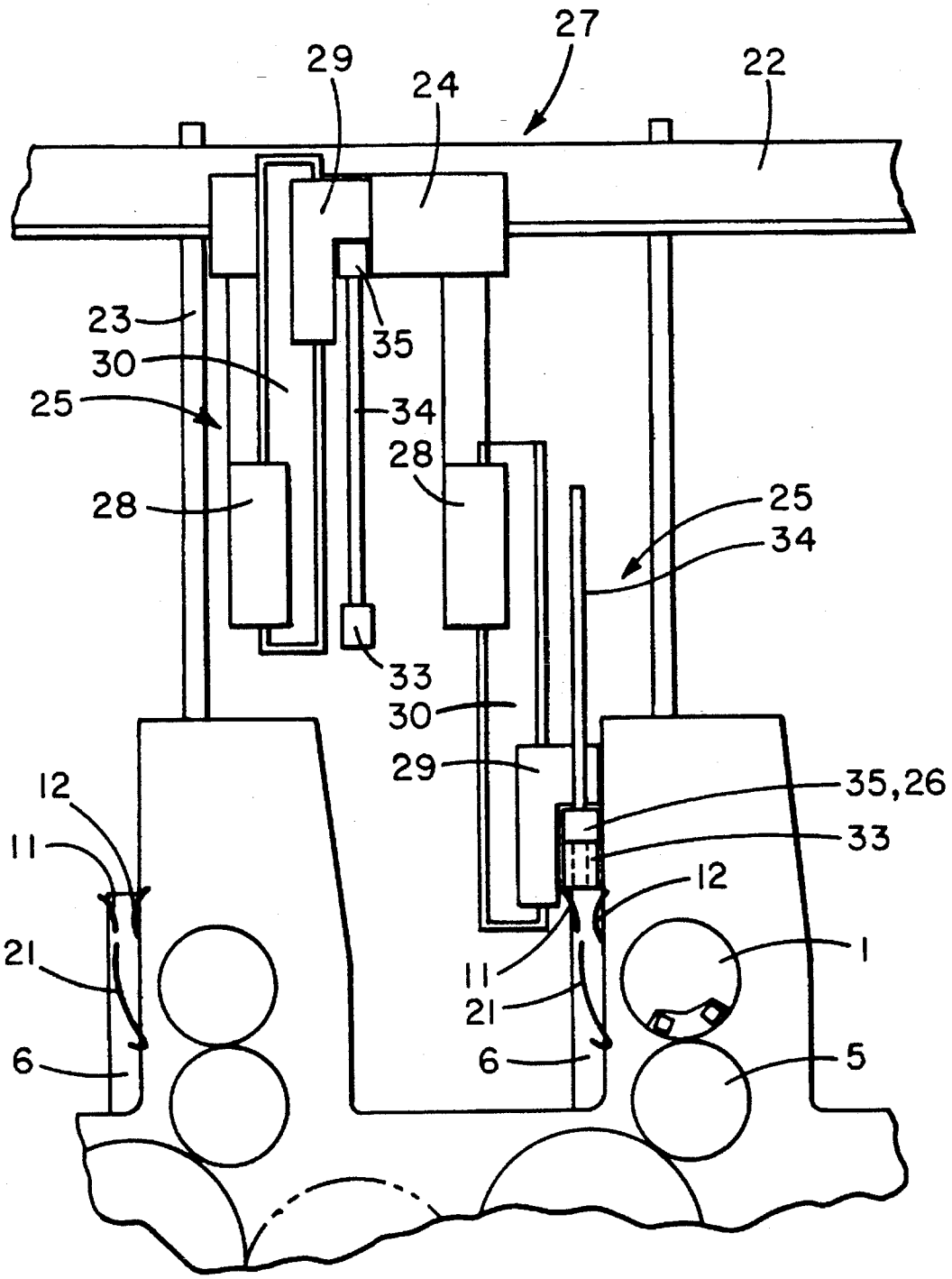

As a comparison of FIGS. 3 and 4 shows, the travelling carriage 24 of the transport apparatus 27 is moved by a certain distance, corresponding to the distance between the two lifting devices, in the direction of the guide rail 22, so that the holding device 26 of the right-hand lifting device 25 is then located exactly above the gap between the guide plates 11 and 12 (FIG. 2). The first and second lifting drives 28, 29 are then activated, so that the holding device 26 of the right-hand lifting device 25 is slowly lowered and the new printing plate is conveyed with its leading end or print start region through the gap of the guide plates 11, 12 and through the guide device 21 thrown onto the plate cylinder 1 and into the opened print start clamping and tension rail 3 (after a corresponding positioning of the plate cylinder). There can be provided on the tension rail 3 sensors, by means of which a correct bearing of the print start region of the printing plate can be detected, whereupon the clamping of the printing plate as a result of the closing of the tension rail 3 is brought about automatically by means of a suitable control.

After the new printing plate has been introduced into the tension rail 3 and clamped, the holding device 26 of the right-hand lifting device 25 can release the trailing or print end region of the printing plate, whereupon the guide device 21 is pivoted off from the plate cylinder 1 and the pressure roller 18 (FIG. 2) is thrown onto the plate cylinder. As a result of the slow forward rotation of the plate cylinder 1, the new printing plate is drawn on around the outer circumference of the latter, until the trailing end comes into the region of the print end tension rail 4, as already described in detail above.

Following release of the trailing end of the printing plate by the holding device 26 of the right-hand lifting device 25, the latter can be moved into its initial position again. On the transport apparatus 27 according to the invention, a used printing plate is now located on the left-hand lifting device 25. The drive of the travelling carriage 24 is then activated, so that the entire transport apparatus 27 comes to rest exactly above a printing plate storage container 31 shown longitudinally in FIG. 1. This printing plate storage container 31 has a plurality of receiving compartments which are located next to one another and are open vertically upwards and which are intended for individual printing plates. As can also be seen in FIG. 1, the transport apparatus 27 is located above the storage container 31. By means of the drive means which can be actuated on the lifting devices 25, a used printing plate can be put into an empty compartment and a new printing plate can be grasped and extracted. As already indicated above, the printing plate storage container 31 can itself be a movable transport container and thus form part of an automatic driverless printing plate logistics system.

When, as described with reference to FIGS. 3 and 4, the printing plate of the first printing unit of the printing machine has been changed and the transport apparatus 27 has deposited the first used printing plate into the printing plate storage container 31, a new printing plate provided for the next printing unit is once again grasped by means of the lifting device 25 located on the right in FIGS. 3 and 4 and is moved to the next printing unit as a result of the appropriate activation of the drive of the travelling carriage 24 of the transport apparatus 27. There, the transport apparatus 27 once again assumes a position according to FIG. 3. The operation described above is repeated.

FIG. 5 illustrates the suspension of the transport apparatus 27 according to the invention above the printing units of the printing machine, as seen from the delivery end of the printing machine. It can be seen here, in particular, that the supports 23 for the guide rail 22 are respectively fastened to a side frame of the driving side and of the tending side of the printing machine. A printing plate 32 is shown on the holding device 26 of the second lifting drive 29 located in its upper end position. In order that used printing plates can be utilized by the apparatus according to the invention, notwithstanding their tendency to roll up, an anti-curl frame is mounted on each lifting device 25 around the printing plate 32. This frame consists essentially of a crosspiece 33 which is somewhat wider than the maximum format of the printing plate 32. The crosspiece 33 has, over its width, a slot, through which the printing plate 32 can be grasped and conveyed by means of the holding device 26. As can be seen in conjunction with FIGS. 3 and 4, the crosspiece 33 is mounted on the end of a respective guide rod 34 and is suspended via the latter on a crosspiece 35 mounted on the second lifting drive 29. Provision is made for supporting this crosspiece 33 on the guard 6 according to FIG. 2 during the downward movement of the rail 30 above the guide plates 11, 12. So that the printing plates are fed exactly in the side register direction, provision can also be made for aligning the crosspiece 33, when it is set down on the guard 6, via stop means brought into contact with one another.

Attached to each of the two ends of the crosspiece 33 is a guide rod 34 corresponding in length approximately to the maximum printing plate format, which guide rods 34 are slipped through via two respective bores at the ends of the second crosspiece 35 and thus make the crosspiece 33 displaceable parallel to this crosspiece 35. This second crosspiece is mounted on the second lifting drive 29, on which the holding devices 26 for the printing plates are also located.

The advantage of the frame-shaped device just described, consisting of the two crosspieces 33, 35 and of the guide rods 34, is that the lower end of the printing plate, that is to say the leading end print start region, does not hang free, but is guided through the gap made in the crosspiece 33. In particular, a used and correspondingly rolled-up printing plate is bent essentially straight and, furthermore, this prevents starting and stopping operations of the travelling carriage 24 from generating an excessive vibration of the used and new printing plates.

The movements and operations described heretofore are executed by an appropriately designed control or are caused by program flow. The sequence for changing the printing plates of a multi-color printing machine can, at the same time, take place in a time-optimized manner, so that the time for drawing on a new printing plate is put to optimum use for fetching a further printing plate from the supply location.

We claim as our invention:

1. Apparatus for the automatic changing of printing plates in sheet-fed offset printing machines having a plurality of printing units each of which includes a plate cylinder with a circumferential gap therein in which remotely actuable clamping devices are disposed adjacent the print start and print end portions of the cylinder for fastening and releasing the leading and trailing ends, respectively, of a preselected one of said printing plates, said automatic changing apparatus comprising, in combination, a printing plate storage container having a plurality of compartments for storing new and used printing plates in a preselected sequence, each compartment for storing a single one of said new and used printing plates, with said trailing ends thereof exposed for subsequent grasping a transport apparatus movable between said plurality of printing units and said storage container, plate holding means mounted on said transport apparatus for grasping only said exposed trailing ends of respective ones of said new and used printing plates, an anti-curl frame mounted on said transport apparatus for engaging said new and used printing plates grasped by said plate holding means and for counteracting the tendency of said leading ends of said printing plates to curl and roll up toward said grasped trailing ends, printing plate guide means including a pivoted portion for mounting in each printing unit, said pivoted portion of said guide means being operatively arranged to be thrown on and thrown off with respect to the plate cylinder of said printing unit, said guide means being operative for receiving a new printing plate from said holding means on said transport apparatus and for guiding said leading end of said new printing plate into engagement with said clamping device disposed adjacent the print start portion of the cylinder, and said guide means also being operative for receiving said trailing end of a used printing plate released from said clamping device disposed adjacent the print end portion of the cylinder and for guiding said trailing end of said used printing into engagement with said holding means on said transport apparatus.

2. Apparatus according to claim 1 including a guide rail for mounting above said plurality of printing units and said printing plate storage container and extending therebetween, wherein said transport apparatus includes a travelling carriage suspended from said guide rail, said transport apparatus also including at least one lifting device, and said holding means for the printing plates being mounted on said lifting device.

3. Apparatus according to claim 2, wherein said guide means includes a pivot axle for mounting adjacent the plate cylinder, wherein said pivoted portion of said guide means includes a profiled member having a first end and a second end, the profiled member being suspended pivotably at said first end about said pivot axle, said profiled member having, at its second end, an introduction rail which for extending over a format width of the plate cylinder and which can be thrown onto the outer circumference of the plate cylinder in such a way that said leading edge of the printing plate can be introduced into the opened clamping device disposed adjacent the print start portion of the cylinder.

4. Apparatus according to claim 3 wherein an introduction face is formed on said introduction rail, said introduction face being arranged towards the plate cylinder.

5. Apparatus according to claim 4 wherein said guide means includes a top portion beneath the transport apparatus, and wherein two guide plates are mounted on said top portion and said guide plates form a gap of format width and through which a new printing plate suspended on said holding means of said lifting device can be fed to the plate cylinder and a used printing plate conveyed out from the plate cylinder can be grasped by means of said holding device.

6. Apparatus according to claim 3 wherein said holding means for the new and used printing plates include gripper elements.

* * * * *